US008958958B2

(12) United States Patent
Imura et al.

(10) Patent No.: US 8,958,958 B2
(45) Date of Patent: Feb. 17, 2015

(54) HYBRID CONSTRUCTION MACHINE

(75) Inventors: Shinya Imura, Toride (JP); Kouji Ishikawa, Kasumigaura (JP); Hidetoshi Satake, Ishioka (JP); Takako Satake, legal representative, Ishioka (JP); Takatoshi Ooki, Kasumigaura (JP); Shinji Nishikawa, Kasumigaura (JP); Manabu Edamura, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 50 days.

(21) Appl. No.: 13/982,563

(22) PCT Filed: Jan. 5, 2012

(86) PCT No.: PCT/JP2012/050128
§ 371 (c)(1),
(2), (4) Date: Nov. 18, 2013

(87) PCT Pub. No.: WO2012/105279
PCT Pub. Date: Aug. 9, 2012

(65) Prior Publication Data

US 2014/0199148 A1 Jul. 17, 2014

(30) Foreign Application Priority Data

Feb. 3, 2011 (JP) ..... 2011-022083

(51) Int. Cl.
*G06F 7/70* (2006.01)
*E02F 9/12* (2006.01)
*E02F 9/20* (2006.01)

(52) U.S. Cl.
CPC ..... *E02F 9/123* (2013.01); *E02F 9/2037* (2013.01); *E02F 9/2095* (2013.01); *Y10S 903/93* (2013.01); *Y10S 903/903* (2013.01)
USPC ..... 701/50; 701/22; 701/42; 701/36; 180/65.285; 180/53.1; 180/68.1; 180/65.28; 180/65.29; 318/369; 318/400.21; 318/519; 903/930; 903/903

(58) Field of Classification Search
CPC ..... E02F 9/123; E02F 9/2296; E02F 9/2095; E02F 9/2217; E02F 9/2075; E02F 9/128; E02F 9/2091; E02F 9/2235; E02F 9/2285; E02F 9/2025; E02F 9/2292; E02F 9/2282; E02F 9/126; E02F 9/20; E02F 9/224
USPC ..... 701/22, 50, 36, 42; 903/903, 930; 180/68.1, 65.29, 65.28
See application file for complete search history.

(56) References Cited

U.S. PATENT DOCUMENTS 8,700,275 B2 * 4/2014 Edamura et al. ..... 701/50
2008/0300757 A1 * 12/2008 Kanayama et al. ..... 701/50

(Continued)

FOREIGN PATENT DOCUMENTS

JP 2001-16704 1/2001
JP 2004-124381 4/2004

(Continued)

*Primary Examiner* — Redhwan k Mawari
(74) *Attorney, Agent, or Firm* — Antonelli, Terry, Stout & Kraus, LLP.

(57) ABSTRACT

In hybrid construction machine employing a hydraulic motor and an electric motor for the driving of the swing structure, satisfactory operability of a combined operation of the swing structure and other actuators is secured irrespective of the operating status of the electric motor.

A control device of the hybrid construction machine executes control selected from: hydraulic/electric complex swing control for driving the swing structure by total torque of the electric motor and the hydraulic motor when a swing operating lever device is operated; and hydraulic solo swing control for driving the swing structure by the torque of the hydraulic motor alone when the swing operating lever device is operated. The control device controls drive torque or driving force of each of the electric motor, the hydraulic motor and a second hydraulic actuator so that the relationship between the position or the speed of the second hydraulic actuator and the swing angle or the swing speed of the swing structure in the combined operation when the swing operating lever device and a second operating lever device are operated at the same time during the hydraulic/electric complex swing control is substantially identical with the relationship in the combined operation during the hydraulic solo swing control.

7 Claims, 10 Drawing Sheets

(56) References Cited

U.S. PATENT DOCUMENTS

| | | | | |
|---|---|---|---|---|
| 2009/0055056 | A1* | 2/2009 | Ooki et al. | 701/50 |
| 2011/0029175 | A1* | 2/2011 | Kang et al. | 701/22 |
| 2011/0029206 | A1* | 2/2011 | Kang et al. | 701/50 |
| 2012/0205171 | A1* | 8/2012 | Takishita et al. | 180/68.1 |
| 2012/0240581 | A1* | 9/2012 | Ooki et al. | 60/711 |
| 2012/0240582 | A1* | 9/2012 | Ooki et al. | 60/711 |
| 2012/0283919 | A1* | 11/2012 | Kuras et al. | 701/50 |
| 2013/0197766 | A1* | 8/2013 | Kurikuma et al. | 701/50 |
| 2013/0245899 | A1* | 9/2013 | Lee et al. | 701/50 |
| 2013/0325269 | A1* | 12/2013 | Izumi et al. | 701/50 |
| 2014/0199148 | A1* | 7/2014 | Imura et al. | 414/687 |

FOREIGN PATENT DOCUMENTS

| | | |
|---|---|---|
| JP | 2004-360216 | 12/2004 |
| JP | 2005-290882 | 10/2005 |
| JP | 2008-63888 | 3/2008 |

* cited by examiner

HYBRID CONSTRUCTION MACHINE

TECHNICAL FIELD

The present invention relates to hybrid construction machine, and in particular, to hybrid construction machine having a swing structure such as a hydraulic excavator.

BACKGROUND ART

A construction machine such as a hydraulic excavator employs fuel (gasoline, light oil, etc.) as the power source of its engine and drives hydraulic actuators (hydraulic motor, hydraulic cylinder, etc.) using hydraulic pressure generated by a hydraulic pump which is driven by the engine. Being small-sized, lightweight and capable of outputting high power, the hydraulic actuators are widely used as actuators for a construction machine.

Meanwhile, there has recently been proposed a construction machine employing an electric motor and an electrical storage device (battery, electric double layer capacitor, etc.) and thereby realizing higher energy efficiency and more energy saving compared to a conventional construction machine employing hydraulic actuators only (see Patent Document 1).

Electric motors (electric actuators) have some excellent features in terms of energy, such as higher energy efficiency compared to hydraulic actuators and the ability to regenerate electric energy from kinetic energy at the time of braking. The kinetic energy is released and lost as heat in the case of hydraulic actuators.

For example, the Patent Document 1 discloses an embodiment of a hydraulic excavator having an electric motor as the actuator for driving the swing structure. The actuator for driving and rotating the upper swing structure of the hydraulic excavator with respect to the lower track structure (implemented by a hydraulic motor in conventional hydraulic excavators) is used frequently and repeats activation/stoppage and acceleration/deceleration frequently in work.

When a hydraulic actuator is used for driving the swing structure, the kinetic energy of the swing structure in deceleration (braking) is lost as heat in the hydraulic circuit. In contrast, energy saving can be realized by use of an electric motor since regeneration of the kinetic energy into electric energy is possible.

There has also been proposed a construction machine that is equipped with both a hydraulic motor and an electric motor so as to drive the swing structure by total torque of the hydraulic motor and the electric motor (see Patent Documents 2 and 3).

The Patent Document 2 discloses an energy regeneration device of a hydraulic construction machine in which an electric motor is connected directly to the hydraulic motor for driving the swing structure. A controller determines the output torque of the electric motor based on the operation amount of the operating lever and sends an output torque command to the electric motor. In deceleration (braking), the electric motor regenerates the kinetic energy of the swing structure into electric energy and accumulates the regenerated energy in a battery.

The Patent Document 3 discloses a hybrid construction machine which performs output torque splitting between the hydraulic motor and the electric motor by calculating a torque command value for the electric motor using the differential pressure between the inlet side and the outlet side of the hydraulic motor for the swing driving.

Both of the conventional techniques of the Patent Documents 2 and 3 employ an electric motor and a hydraulic motor together as the actuators for the swing driving and thereby realize operation with no feeling of strangeness even for operators accustomed to a conventional construction machine driven by a hydraulic actuator, as well as achieving energy saving with a configuration that is simple and easy to put into practical use.

PRIOR ART LITERATURE

Patent Documents

Patent Document 1: JP-2001-16704-A
Patent Document 2: JP-2004-124381-A
Patent Document 3: JP-2008-63888-A

SUMMARY OF THE INVENTION

Problem to be Solved by the Invention

In the hybrid hydraulic excavator described in the Patent Document 1, the kinetic energy of the swing structure in deceleration (braking) is regenerated by the electric motor into electric energy, which is effective from the viewpoint of energy saving.

However, using an electric motor, having different characteristics from hydraulic motors, for driving the swing structure of the construction machine can cause the following problems:

(1) Hunting (especially in a low speed range and in the stopped state) due to insufficient speed feedback control of the electric motor.

(2) Feeling of strangeness about the operation (manipulation) of the construction machine caused by the difference in characteristics from hydraulic motors.

(3) Overheating of the motor or inverter during an operation/work (e.g., pressing operation) that requires continuous torque output with no rotation of the motor.

(4) Excessive increase in the overall size or considerable increase in costs due to the use of an electric motor guaranteeing high output equivalent to that of hydraulic motors.

The hybrid hydraulic excavators described in the Patent Documents 2 and 3 solve the above problems by employing both a hydraulic motor and an electric motor and driving the swing structure by the total torque of the motors, thereby realizing operation with no feeling of strangeness even for operators accustomed to a conventional construction machine driven by a hydraulic actuator, as well as achieving energy saving with a configuration that is simple and easy to put into practical use.

However, in every one of the conventional techniques described in the above Patent Documents 1-3, the electric motor is constantly in charge of a certain part of the total torque necessary for the swing driving. Therefore, when the electric motor is incapable of generating torque for some reason (failure/abnormality in an electric system (inverter, motor, etc.), a low energy state or an overcharged state of the electrical storage device, etc.), the total torque becomes insufficient for driving the swing structure and that leads to deterioration in the operability of the swing structure.

When a hydraulic excavator is used for loading earth and sand onto a dump truck, a combined operation of raising the boom of the hydraulic excavator while swinging (rotating) the swing structure is performed successively and the drive torque for driving the swing structure can become insufficient. In such cases, the relationship between the position or the speed of the boom and the swing angle or the swing speed of the swing structure can become unbalanced. If the operator operates the boom as usual in such cases, the bucket of the hydraulic excavator might be raised too high above the bed of the dump truck and earth and sand released from the high position can put an excessive impact on the dump truck. When the relationship between the boom speed and the swing speed in the combined operation becomes unbalanced as above, the operator is forced to operate the hydraulic excavator more carefully than usual, resulting in poor operability of the hydraulic excavator for the operator.

The object of the present invention, which has been made in consideration of the above situation, is to provide a hybrid construction machine employing a hydraulic motor and an electric motor for the driving of the swing structure and being capable of securing satisfactory operability in the combined operation of the swing structure and other actuators irrespective of the operating status of the electric motor.

Means for Solving the Problem

To achieve the above object, according to a first aspect of the present invention, there is provided a hybrid construction machine comprising: a prime mover; a hydraulic pump which is driven by the prime mover; a swing structure; an electric motor for driving the swing structure; a hydraulic motor for driving the swing structure, the hydraulic motor being driven by the hydraulic pump; an electrical storage device which is connected to the electric motor; a swing operating lever device which is operated for commanding the driving of the swing structure; a second hydraulic actuator which is driven by the hydraulic pump and drives a driven part other than the swing structure; a second operating lever device which is operated for commanding the driving of the second hydraulic actuator; and a control device which executes control selected from: hydraulic/electric complex swing control for driving the swing structure by total torque of the electric motor and the hydraulic motor by driving both the electric motor and the hydraulic motor when the swing operating lever device is operated; and hydraulic solo swing control for driving the swing structure by the torque of the hydraulic motor alone by driving only the hydraulic motor when the swing operating lever device is operated. The control device controls drive torque of the electric motor, drive torque of the hydraulic motor and driving force of the second hydraulic actuator so that the relationship between the position or the speed of the second hydraulic actuator and the swing angle or the swing speed of the swing structure when the swing operating lever device and the second operating lever device are operated at the same time during the hydraulic/electric complex swing control is substantially identical with the relationship between the position or the speed of the second hydraulic actuator and the swing angle or the swing speed of the swing structure when the swing operating lever device and the second operating lever device are operated at the same time during the hydraulic solo swing control.

According to a second aspect of the present invention, there is provided the hybrid construction machine as described in the first aspect, wherein when the swing operating lever device and the second operating lever device are operated at the same time during the hydraulic/electric complex swing control, the control device controls the drive torque of the electric motor so that the ratio of the drive torque of the electric motor to the drive torque of the hydraulic motor decreases with the increase in the operation amount of the second operating lever device.

According to a third aspect of the present invention, there is provided the hybrid construction machine as described in the first aspect, wherein when the swing operating lever device is operated during the hydraulic/electric complex swing control, the control device increases the drive torque of the electric motor and controls the drive torque of the hydraulic motor so as to reduce the drive torque of the hydraulic motor by an amount corresponding to the increase in the drive torque of the electric motor.

According to a fourth aspect of the present invention, there is provided the hybrid construction machine as described in the first aspect, wherein when the swing operating lever device and the second operating lever device are operated at the same time during the hydraulic solo swing control, the control device controls the driving force of the second hydraulic actuator so as to reduce the driving force of the second hydraulic actuator.

According to a fifth aspect of the present invention, there is provided the hybrid construction machine as described in the first aspect, wherein the second hydraulic actuator is a boom cylinder, and the second operating lever device is a boom raising operating lever device.

According to a sixth aspect of the present invention, there is provided the hybrid construction machine as described in the third aspect, wherein the control device reduces the drive torque of the hydraulic motor by performing reduction control on the output of the hydraulic pump.

According to a seventh aspect of the present invention, there is provided the hybrid construction machine as described in the fourth aspect, wherein the control device reduces the driving force of the second hydraulic actuator by performing reduction control on the output of the hydraulic pump.

Effect of the Invention

According to the present invention, satisfactory operability in the combined operation of the swing structure and other actuators can be secured irrespective of the operating status of the electric motor.

BRIEF DESCRIPTION OF THE DRAWINGS

FIG. 4 shows control gain characteristic diagrams of a controller constituting the hybrid construction machine in accordance with the first embodiment of the present invention, wherein

MODE FOR CARRYING OUT THE INVENTION

Figure 1:
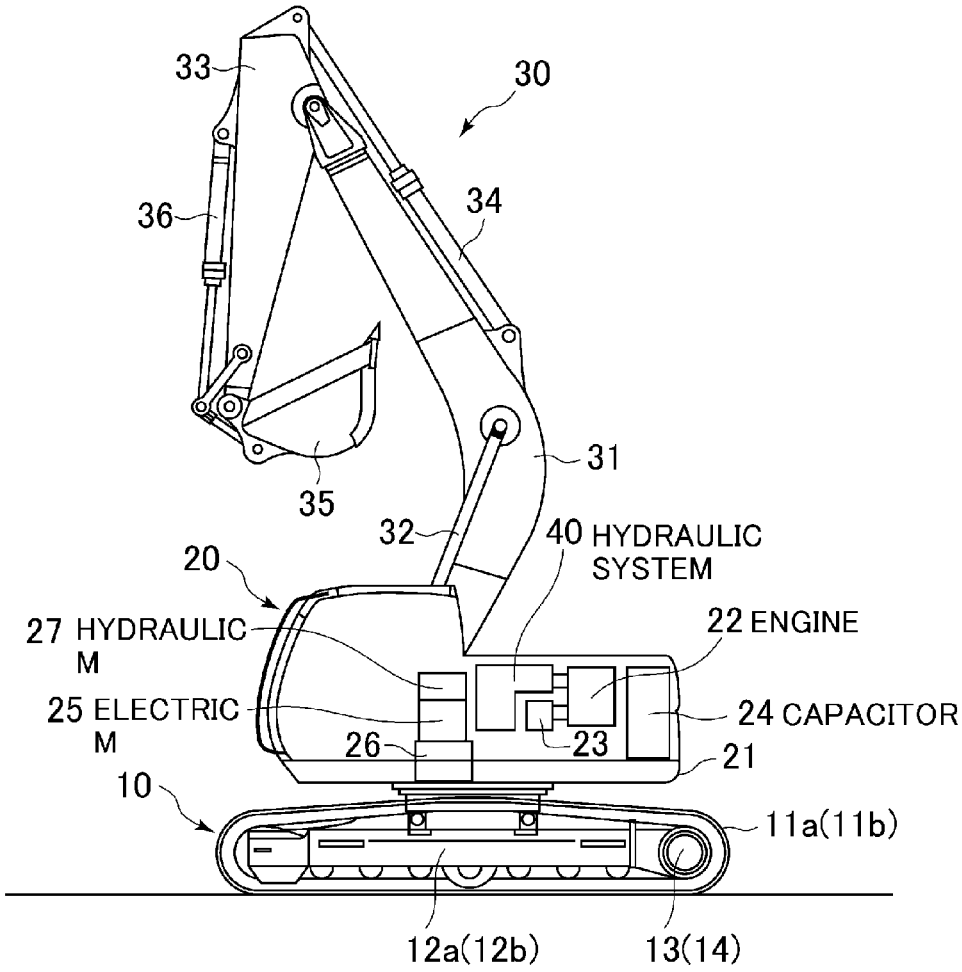
FIG. 1 is a side view of a hybrid construction machine in accordance with a first embodiment of the present invention.
Figure 2:
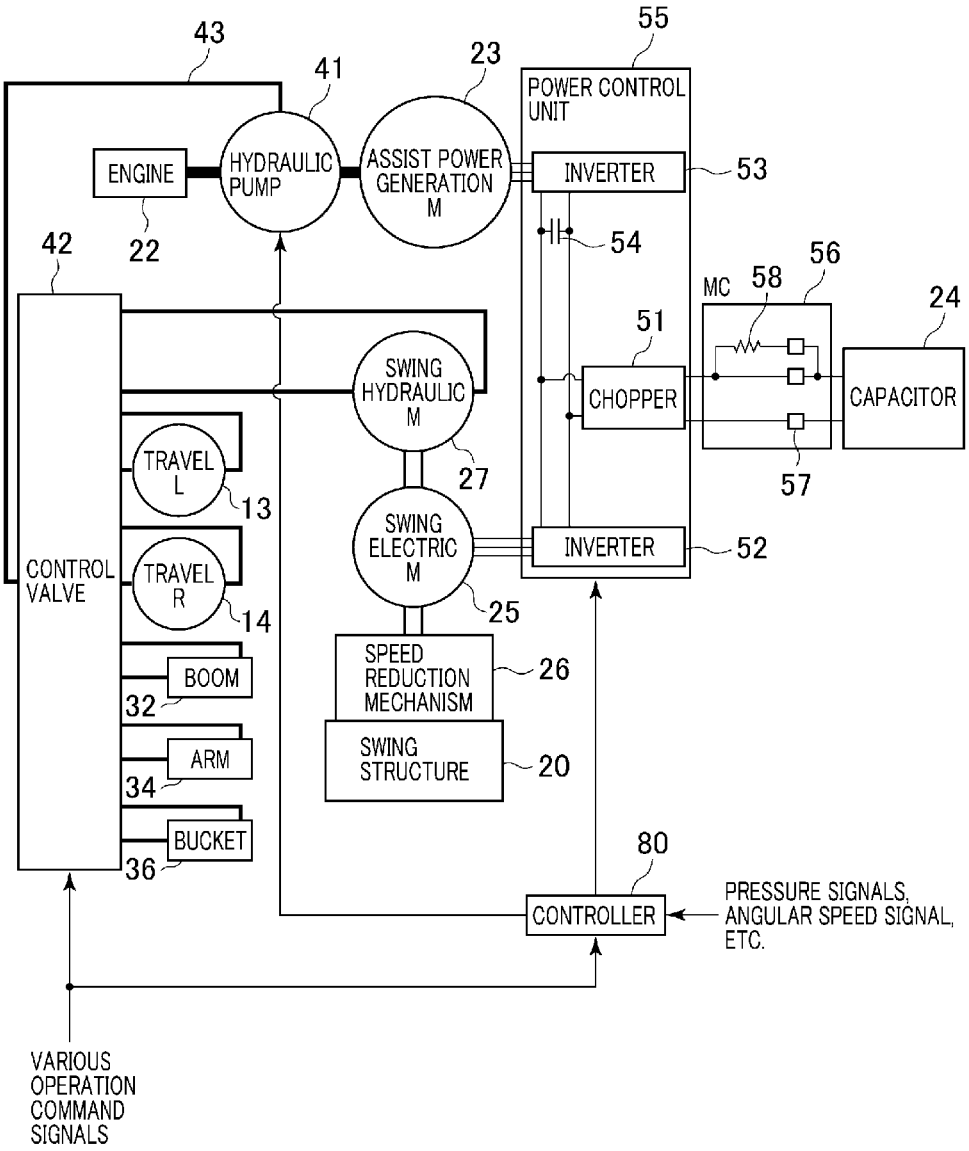
FIG. 2 is a system configuration diagram of electric/hydraulic devices constituting the hybrid construction machine in accordance with the first embodiment of the present invention.
Figure 3:
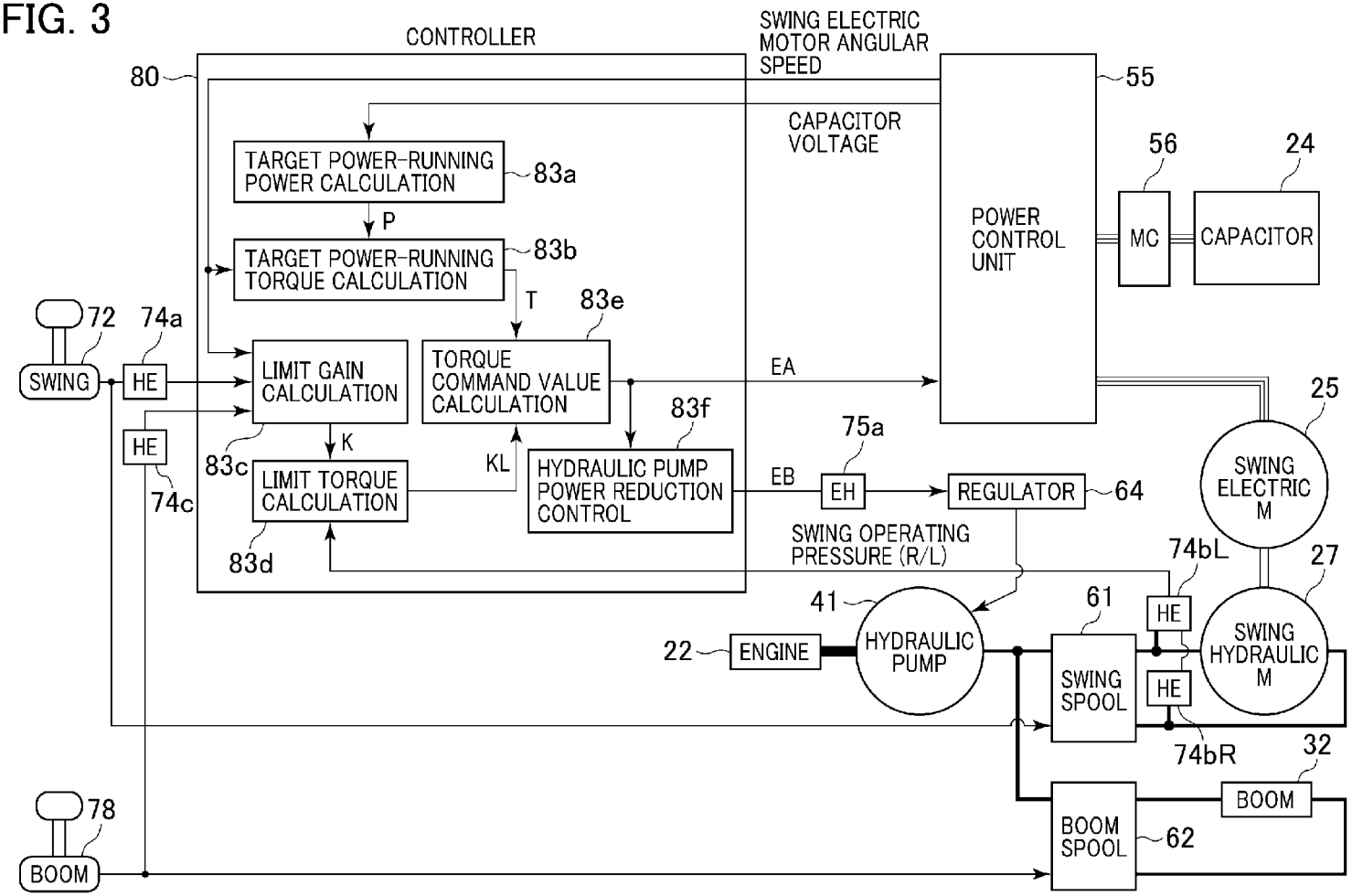
FIG. 3 is a block diagram showing the system configuration and control blocks of the hybrid construction machine in accordance with the first embodiment of the present invention.

In the following, embodiments of the present invention will be described with reference to figures, by taking a hydraulic excavator as an example of construction machine. It should be noted that the present invention can be applied to all construction machines (including work machines) equipped with a swing structure and that the application of this invention is not limited to the hydraulic excavator. For example, the invention can also be applied to a crane vehicle equipped with a swing structure and other construction machines. FIG. 1 is a side view of a hybrid construction machine in accordance with a first embodiment of the present invention. FIG. 2 is a system configuration diagram of electric/hydraulic devices constituting the hybrid construction machine in accordance with the first embodiment of the present invention. FIG. 3 is a block diagram showing the system configuration and control blocks of the hybrid construction machine in accordance with the first embodiment of the present invention.

In FIG. 1, an electrically-driven hydraulic excavator comprises a track structure 10, a swing structure 20 mounted on the track structure 10 to be rotatable, and an excavation mechanism 30 attached to the swing structure 20.

The track structure 10 is made up of a symmetrical pair of crawlers 11 and a symmetrical pair of crawler frames 12 (shown only one each in FIG. 1), a pair of track hydraulic motors 13 and 14 for performing drive control of the crawlers 11 independently of one another, and a speed reduction mechanism working in conjunction with the track hydraulic motors 13 and 14.

The swing structure 20 includes a swing frame 21, an engine 22 (as a prime mover) mounted on the swing frame 21, an assist power generation motor 23 driven by the engine 22, a swing electric motor 25, a capacitor 24 (as an electrical storage device connected to the assist power generation motor 23 and the swing electric motor 25), a speed reduction mechanism 26 for decelerating the rotation of the swing electric motor 25, etc. The driving force of the swing electric motor 25 is transmitted via the speed reduction mechanism 26, by which the swing structure 20 (swing frame 21) is driven and rotated with respect to the track structure 10.

The swing structure 20 is equipped with the excavation mechanism (front device) 30. The excavation mechanism 30 includes a boom 31, a boom cylinder 32 for driving the boom 31, an arm 33 supported by a distal end part of the boom 31 to be rotatable around an axis, an arm cylinder 34 for driving the arm 33, a bucket 35 supported by the distal end of the arm 33 to be rotatable around an axis, a bucket cylinder 36 for driving the bucket 35, etc.

Further, a hydraulic system 40 for driving hydraulic actuators (such as the travel hydraulic motors 13 and 14, a swing hydraulic motor 27, the boom cylinder 32, the arm cylinder 34 and the bucket cylinder 36) is mounted on the swing frame 21 of the swing structure 20. The hydraulic system 40 includes a hydraulic pump 41 (see FIG. 2) as a hydraulic pressure source for generating the hydraulic pressure and a control valve 42 (see FIG. 2) for driving and controlling the actuators. The hydraulic pump 41 is driven by the engine 22.

Next, the system configuration of the electric/hydraulic devices of the hydraulic excavator will be explained briefly. As shown in FIG. 2, the control valve 42 controls the flow rate and the direction of the hydraulic oil supplied to the swing hydraulic motor 27 by operating a swing spool 61 (see FIG. 3) according to a swing operation command (hydraulic pilot signal) inputted from a swing operating lever device 72 (see FIG. 3). The control valve 42 also controls the flow rate and the direction of the hydraulic oil supplied to each of the boom cylinder 32, the arm cylinder 34, the bucket cylinder 36 and the travel hydraulic motors 13 and 14 by operating various spools according to operation commands (hydraulic pilot signals) inputted from operating lever devices for operations other than the swinging.

An electric system of the hydraulic excavator is made up of the assist power generation motor 23, the capacitor 24, the swing electric motor 25, a power control unit 55, a main contactor 56, etc. The power control unit 55 includes a chopper 51, inverters 52 and 53, a smoothing capacitor 54, etc. The main contactor 56 includes a main relay 57, an inrush current prevention circuit 58, etc.

The voltage of DC power supplied from the capacitor 24 is boosted by the chopper 51 to a predetermined bus voltage and is inputted to the inverter 52 (for driving the swing electric motor 25) and the inverter 53 (for driving the assist power generation motor 23). The smoothing capacitor 54 is used for stabilizing the bus voltage. The swing electric motor 25 and the swing hydraulic motor 27, whose rotating shafts are connected to each other, cooperatively drive the swing structure 20 via the speed reduction mechanism 26. The capacitor 24 is charged or discharged depending on the driving status (regenerating or power running) of the assist power generation motor 23 and the swing electric motor 25.

A controller 80 generates control commands for the control valve 42 and the power control unit 55 by using various operation command signals, pressure signals of the swing hydraulic motor 27, an angular speed signal of the swing electric motor 25, etc. and thereby executes torque control of the swing electric motor 25, discharge flow rate control of the hydraulic pump 41, etc.

FIG. 3 is a block diagram showing the system configuration and control blocks of the hydraulic excavator. While the system configuration of the electric/hydraulic devices shown in FIG. 3 is basically identical with that in FIG. 2, devices, control means, control signals, etc. necessary for carrying out the swing control in accordance with the present invention are shown in detail in FIG. 3.

The hybrid hydraulic excavator shown in FIG. 3 is equipped with the aforementioned controller 80 and units (hydraulic-electric conversion units 74*a*, 74*b*L, 74*b*R and 74*c* and an electric-hydraulic conversion unit 75*a*) related to the input/output of the controller 80. These components constitute a swing control system. The hydraulic-electric conversion units 74*a*, 74*b*L, 74*b*R and 74*c* are implemented by pressure sensors, for example. The electric-hydraulic conversion unit 75*a* is implemented by a solenoid-operated proportional pressure-reducing valve, for example.

The controller 80 includes a target power-running power calculation block 83*a*, a target power-running torque calculation block 83*b*, a limit gain calculation block 83*c*, a limit torque calculation block 83*d*, a torque command value calculation block 83*e*, a hydraulic pump power reduction control block 83*f*, etc.

The hydraulic pilot signal generated according to the operator's input to the swing operating lever device 72 is converted by the hydraulic-electric conversion unit 74*a* into an electric signal and inputted to the limit gain calculation block 83*c*. A hydraulic pilot signal generated according to the operator's input to a boom operating lever device 78 (as an operating lever device for an operation other than the swinging) is converted by the hydraulic-electric conversion unit 74*c* into an electric signal and inputted to the limit gain calculation block 83*c*. Operating pressures of the swing hydraulic motor 27 are converted by the hydraulic-electric conversion units 74*b*R and 74*b*L into electric signals and inputted to the limit torque calculation block 83*d*. The angular speed signal (ω) of the swing electric motor 25, which is outputted by an inverter of the power control unit 55 for driving the electric motor, is inputted to the target power-running torque calculation block 83*b* and the limit gain calculation block 83*c*. Capacitor voltage Vc indicating the amount of electricity stored in the capacitor 24 (electric amount of the capacitor 24) is inputted to the target power-running power calculation block 83*a* via the power control unit 55. The torque command value calculation block 83*e* calculates command torque for the swing electric motor 25 as explained later and outputs a torque command EA to the power control unit 55. At the same time, a torque reduction command EB for reducing the output torque of the hydraulic pump 41 by the torque outputted by the swing electric motor 25 is outputted from the hydraulic pump power reduction control block 83*f* to the electric-hydraulic conversion unit 75*a*. A hydraulic pilot signal from the electric-hydraulic conversion unit 75*a* is inputted to a regulator 64 which controls the discharge flow rate of the hydraulic pump 41.

Meanwhile, the hydraulic pilot signal generated according to the operator's input to the swing operating lever device 72 is inputted also to the control valve 42, by which the spool 61 for the swing hydraulic motor 27 is switched from its neutral position, the hydraulic oil discharged from the hydraulic pump 41 is supplied to the swing hydraulic motor 27, and consequently, the swing hydraulic motor 27 is also driven at the same time.

Similarly, the hydraulic pilot signal generated according to the operator's input to the boom operating lever device 78 is inputted also to the control valve 42, by which a spool 62 for the boom is switched and the hydraulic oil discharged from the hydraulic pump 41 is supplied to the boom cylinder 32 to drive the boom 31.

The hydraulic pump 41 is a variable displacement pump. By the operation of the regulator 64, the tilting angle of the hydraulic pump 41 is changed, the displacement (capacity) of the hydraulic pump 41 is changed, and consequently, the discharge flow rate and the torque of the hydraulic pump 41 are changed.

Incidentally, while this explanation is given by using an example in which the swing hydraulic motor 27 and the boom cylinder 32 are connected in parallel to the hydraulic pump 41 via the swing spool 61 and the boom spool 62, the connection of actuators to the hydraulic pump 41 is not restricted to this example. The present invention is applicable also to cases where different actuators other than the boom cylinder 32 are connected in parallel with the swing hydraulic motor 27.

Figure 4A:
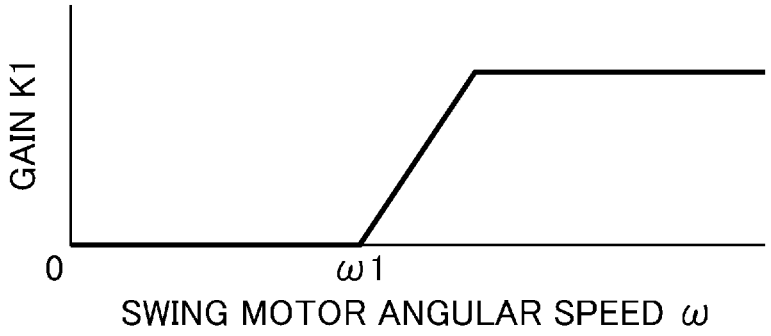
FIG. 4(A) is a characteristic diagram of gain K1.
Figure 4B:
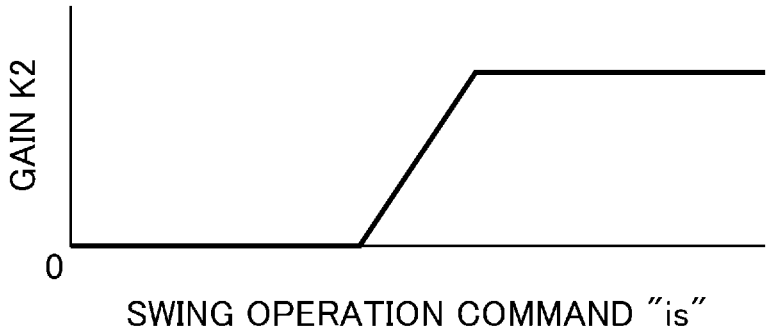
FIG. 4(B) is a characteristic diagram of gain K2.
Figure 4C:
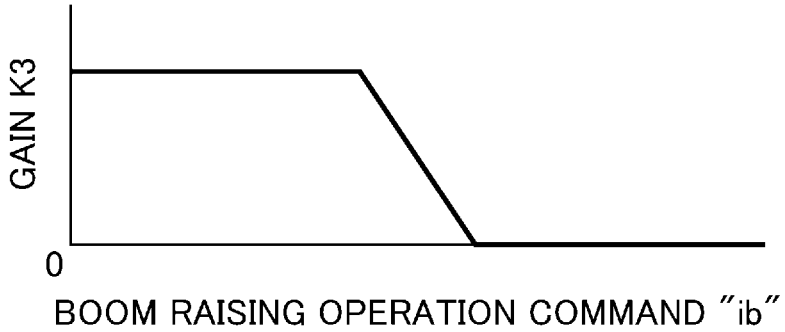
FIG. 4(C) is a characteristic diagram of gain K3.
Figure 5:
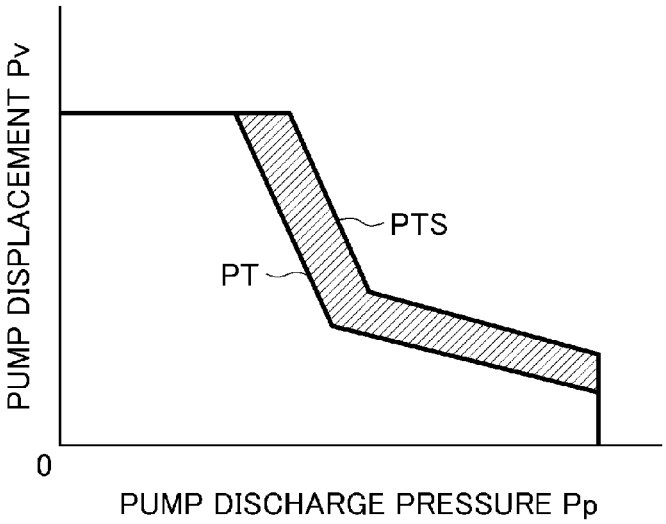
FIG. 5 is a characteristic diagram showing torque control characteristics of a hydraulic pump in the hybrid construction machine in accordance with the first embodiment of the present invention.

Next, the details of the control by the controller 80 will be explained referring to FIGS. 3-5. FIG. 4 shows control gain characteristic diagrams of the controller constituting the hybrid construction machine in accordance with the first embodiment of the present invention, wherein FIG. 4(A) is a characteristic diagram of gain K1, FIG. 4(B) is a characteristic diagram of gain K2, and FIG. 4(C) is a characteristic diagram of gain K3. FIG. 5 is a characteristic diagram showing torque control characteristics of the hydraulic pump in the hybrid construction machine in accordance with the first embodiment of the present invention. Reference characters in FIGS. 4 and 5 identical with those in FIGS. 1-3 represent components identical or corresponding to those in FIGS. 1-3, and thus repeated explanation thereof is omitted for brevity.

Referring first to FIG. 3, the target power-running power calculation block 83*a* receives the voltage value Vc of the capacitor 24 from the power control unit 55 as an input signal, compares the voltage value Vc with a preset operational threshold Vp for permitting the operation of the swing electric motor 25, and outputs an output value P. When the electric amount (the amount of stored electricity) of the capacitor 24 is large (i.e., when the capacitor voltage Vc is higher than the operational threshold Vp), a positive value is outputted as the output value P. When the electric amount is small (i.e., when the capacitor voltage Vc is lower than the operational threshold Vp), 0 is outputted as the output value P. In the case where a positive value is outputted as the output value P, the output value P may be changed depending on the difference between the capacitor voltage Vc and the operational threshold Vp.

The operational threshold Vp of the swing electric motor 25 is a voltage value of the capacitor 24 at/above which the balance between the charging and the discharging of the capacitor 24 can be maintained during the regeneration and the power running for preset operational patterns of the swing electric motor 25. The operational threshold Vp of the swing electric motor 25 has been set higher than the operation guarantee minimum voltage value of the capacitor 24 and lower than the operation guarantee maximum voltage value of the capacitor 24. For example, the operational threshold Vp may be set at 120 V when the operation guarantee minimum voltage value of the capacitor 24 is 100 V. If the operational threshold Vp is set at 100 V in this case, the capacitor voltage Vc tends to fall below the operation guarantee minimum voltage of the capacitor 24 since the driving of the swing electric motor 25 is possible (permitted) as long as the capacitor voltage Vc is 100 V or higher. To avoid this problem, the operation of the swing electric motor 25 is permitted only above the voltage value at which the balance between charging and the discharging of the capacitor 24 can be maintained.

The target power-running torque calculation block 83*b* receives the angular speed signal ω of the swing electric motor 25 from the power control unit 55 and the aforementioned output value P from the target power-running power calculation block 83*a* as input signals, calculates target power-running torque T by dividing the output value P by the angular speed signal ω, and outputs the calculated target power-running torque T. Incidentally, the value of the target power-running torque T is restricted within the range of torque that can be generated by the swing electric motor 25.

The limit gain calculation block 83*c* receives the angular speed signal ω of the swing electric motor 25 from the power control unit 55, the swing operation command converted into an electric signal by the hydraulic-electric conversion unit 74*a*, and a boom raising operation command converted into an electric signal by the hydraulic-electric conversion unit 74*c* as input signals. The limit gain calculation block 83*c* calculates gain outputs K1-K3 from these values, calculates a limit gain K by multiplying the gain outputs K1-K3 together, and outputs the calculated limit gain K. An example of characteristic tables for determining these gains K1-K3 is shown in FIGS. 4(A), 4(B) and 4(C).

FIG. 4(A) shows a characteristic table for determining the gain K1. By use of the table, the gain K1 is determined for a signal representing the absolute value of the angular speed signal ω of the swing electric motor 25. In FIG. 4(A), the angular speed ω1 represents the angular speed at which the gain K1 becomes higher than 0 (startup permissible angular speed of the swing electric motor 25). Since the swing electric motor 25 and the swing hydraulic motor 27 are connected together by the rotating shaft, the angular speed ω of the swing electric motor 25 equals the angular speed of the swing hydraulic motor 27.

FIG. 4(B) shows a characteristic table for determining the gain K2. By use of the table, the gain K2 is determined for the swing operation command signal (is).

FIG. 4(C) shows a characteristic table for determining the gain K3. By use of the table, the gain K3 is determined for the boom raising operation command signal (ib). The gain K3 decreases with the increase in the value of the boom raising operation command signal "ib" as shown in FIG. 4(C). Since the limit gain K is the product of the gains K1-K3, the limit gain K decreases with the increase in the value of the boom raising operation command signal "ib" and is eventually fixed at zero output.

Returning to FIG. 3, the limit torque calculation block 83*d* receives the operating pressure signal of the swing hydraulic motor 27 and the aforementioned limit gain K (output value of the limit gain calculation block 83*c*) as input signals. The limit torque calculation block 83*d* calculates and outputs limit torque KL by multiplying the torque of the swing hydraulic motor 27 (calculated from the operating pressure signal of the swing hydraulic motor 27) by the limit gain K.

The torque command value calculation block 83*e* receives the target power-running torque T calculated by the target power-running torque calculation block 83*b* and the limit torque KL calculated by the limit torque calculation block 83*d* as input signals. The torque command value calculation block 83*e* executes a calculation for limiting the target power-running torque T by the value of the limit torque KL and outputs a torque command value EA as the result of the calculation to the power control unit 55 and the hydraulic pump power reduction control block 83*f*. The power control unit 55 makes the swing electric motor 25 generate torque according to the torque command value EA.

The hydraulic pump power reduction control block 83*f* receives the torque command value EA calculated by the torque command value calculation block 83*e* as an input signal and outputs a power reduction command EB (for reducing the discharge flow rate of the hydraulic pump 41) so that the torque of the swing hydraulic motor 27 is reduced by the added torque of the swing electric motor 25. Specifically, the hydraulic pump power reduction command EB is outputted from the hydraulic pump power reduction control block 83*f* to the electric-hydraulic conversion unit 75*a*. The electric-hydraulic conversion unit 75*a* outputs control pressure corresponding to this electric signal to the regulator 64. The regulator 64 controls the tilting angle of the swash plate of the hydraulic pump 41 according to the control pressure, by which the maximum power of the hydraulic pump 41 is reduced. Consequently, the torque of the swing hydraulic motor 27 decreases.

FIG. 5 shows the torque control characteristics of the hydraulic pump 41, wherein the horizontal axis represents the discharge pressure Pp of the hydraulic pump 41 and the vertical axis represents the pump displacement Pv of the hydraulic pump 41.

When the value of the hydraulic pump power reduction command EB is high, the control pressure from the electric-hydraulic conversion unit 75*a* is high. In this case, the setting of the regulator 64 is changed to the characteristics of the solid line PT where the maximum output torque is lower than that represented by the solid line PTS. In contrast, when the value of the hydraulic pump power reduction command EB decreases, the setting of the regulator 64 changes from the characteristics of the solid line PT to the characteristics of the solid line PTS, by which the maximum output torque of the hydraulic pump 41 is increased by the area of the hatching.

Figure 6:
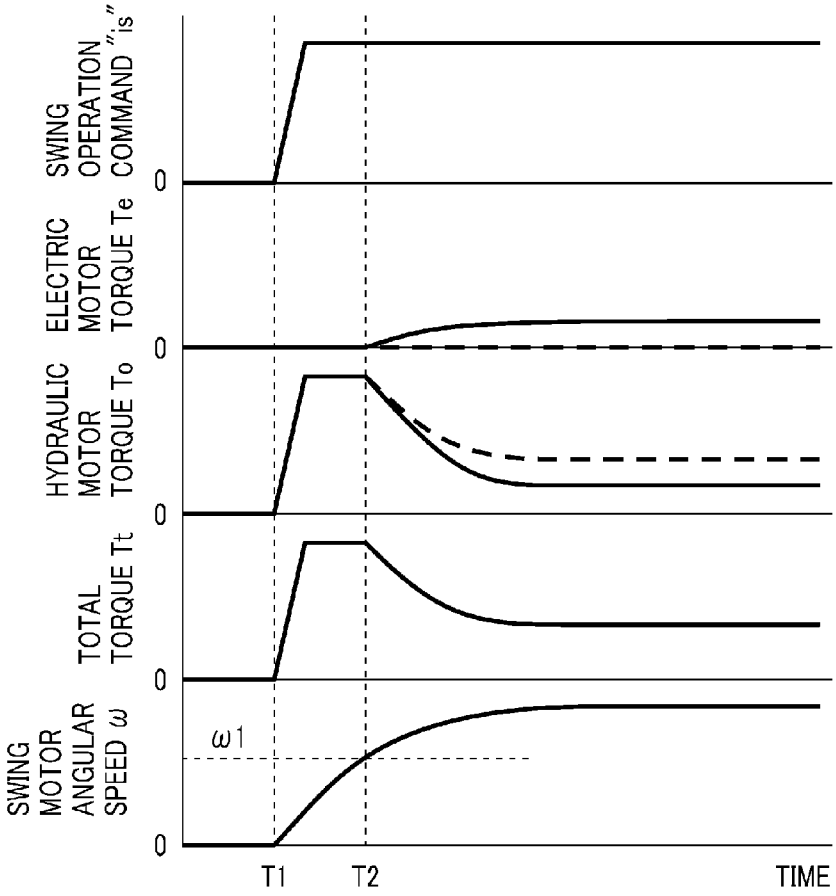
FIG. 6 is a characteristic diagram showing an example of the relationship among the electric motor torque, the hydraulic motor torque, the swing angular speed, etc. in the swinging of the hybrid construction machine in accordance with the first embodiment of the present invention.
Figure 7:
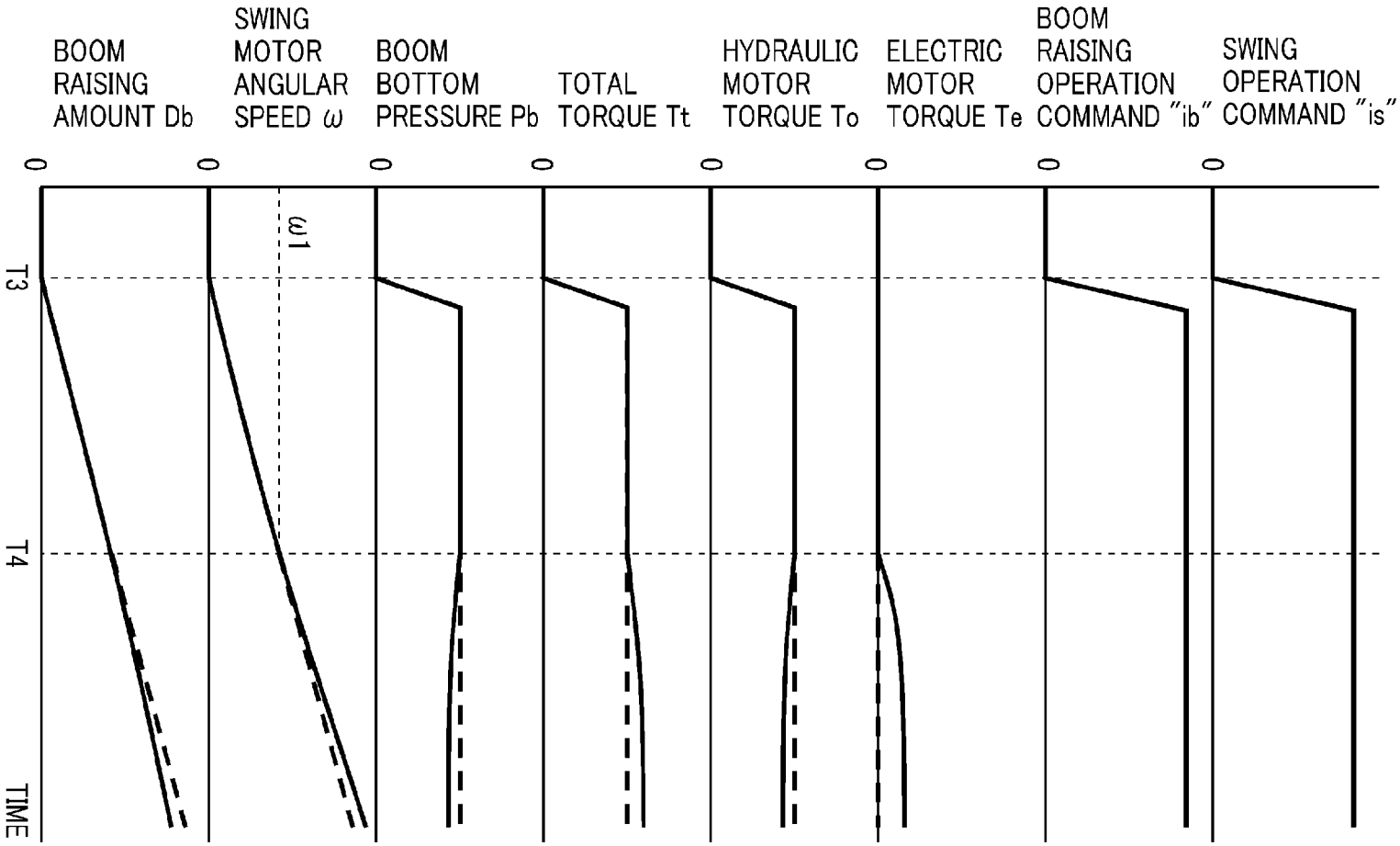
FIG. 7 is a characteristic diagram showing an example of the relationship among the electric motor torque, the hydraulic motor torque, the swing angular speed, etc. in the swing boom raising operation of hybrid construction machine.
Figure 8:
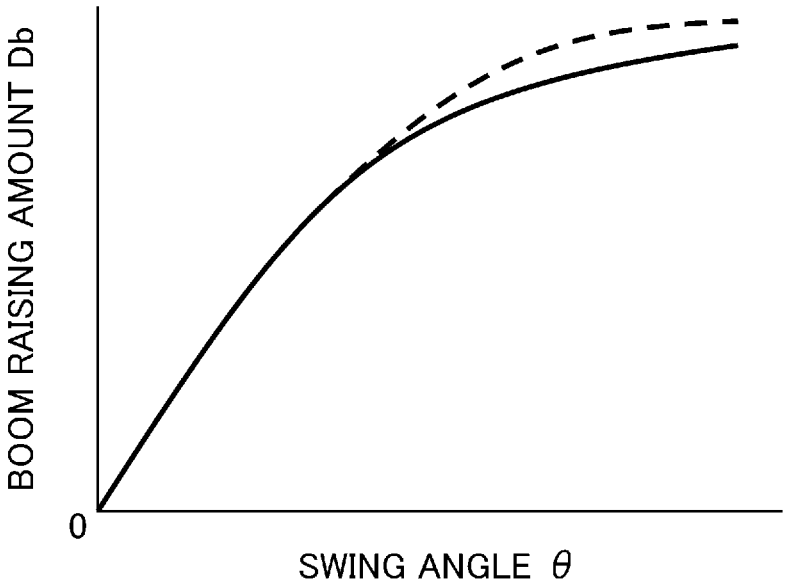
FIG. 8 is a characteristic diagram showing an example of the relationship between a boom raising level and a swing angle determined from the characteristic diagram of FIG. 7.
Figure 9:
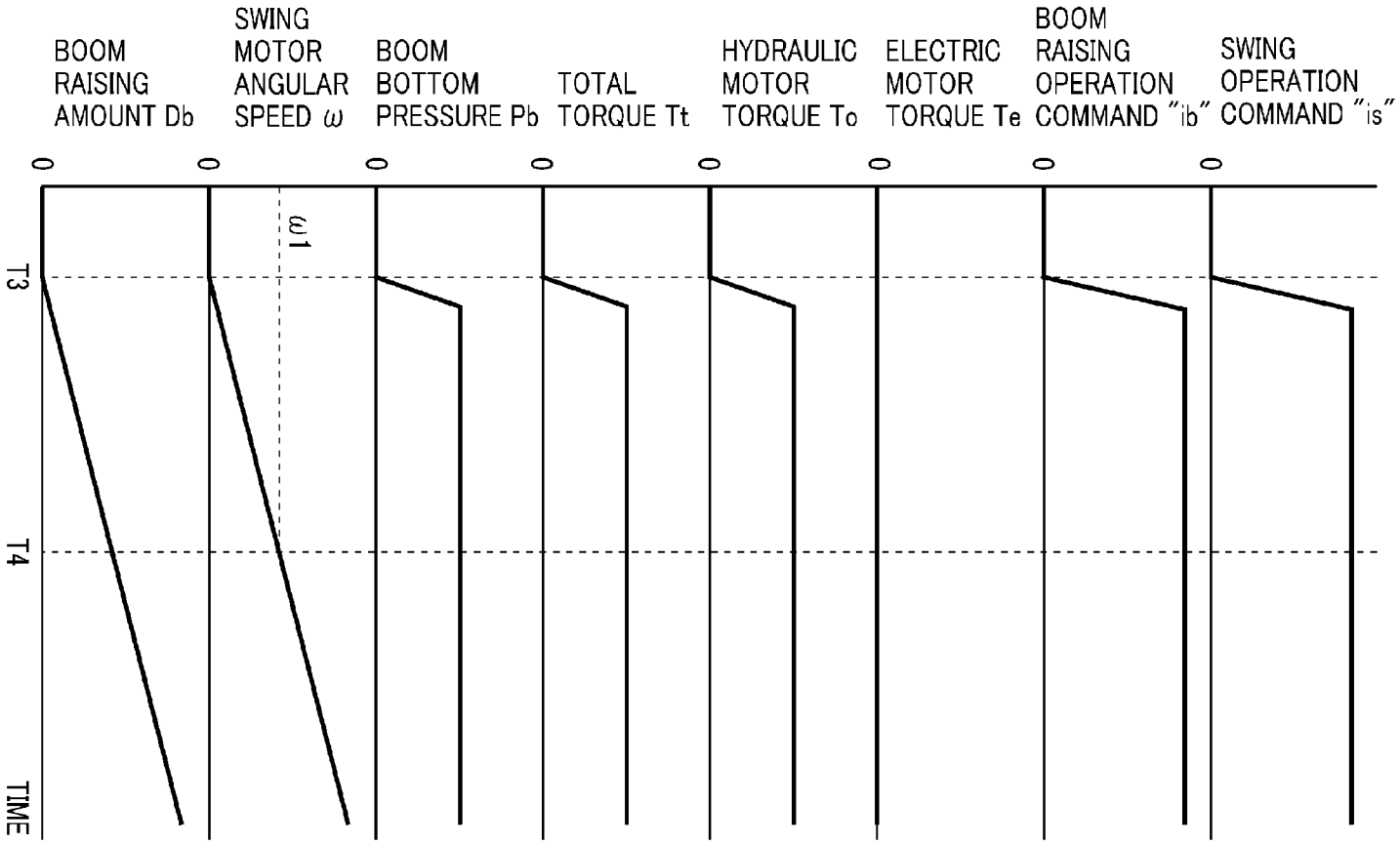
FIG. 9 is a characteristic diagram showing an example of the relationship among the electric motor torque, the hydraulic motor torque, the swing angular speed, etc. in the swing boom raising operation of the hybrid construction machine in accordance with the first embodiment of the present invention.

Next, the operation of the hybrid construction machine in accordance with the first embodiment of the present invention will be explained below referring to FIGS. 6-9. FIG. 6 is a characteristic diagram showing an example of the relationship among the electric motor torque, the hydraulic motor torque, the swing angular speed, etc. in the swinging of the hybrid construction machine in accordance with the first embodiment of the present invention. FIG. 7 is a characteristic diagram showing an example of the relationship among the electric motor torque, the hydraulic motor torque, the swing angular speed, etc. in the swing boom raising operation of hybrid construction machine. FIG. 8 is a characteristic diagram showing an example of the relationship between a boom raising level and a swing angle determined from the characteristic diagram of FIG. 7. FIG. 9 is a characteristic diagram showing an example of the relationship among the electric motor torque, the hydraulic motor torque, the swing angular speed, etc. in the swing boom raising operation of the hybrid construction machine in accordance with the first embodiment of the present invention.

FIG. 6 shows characteristics of the hybrid construction machine when only the swing operation is performed. In FIG. 6, the broken lines represent the operation when the voltage value Vc of the capacitor 24 is lower than the operational threshold Vp and the solid lines represent the operation when the voltage value Vc is higher than the operational threshold Vp. In each of the graphs of the swing operation command "is", the total torque Tt and the swing motor angular speed ω, the broken line and the solid line coincide with each other.

Specifically, when the swing operation is started first at time T1, the torque To of the swing hydraulic motor 27 and the total torque Tt increase and then the angular speed signal ω of the swing motor increases following the torque To and the total torque Tt. When the angular speed signal ω of the swing motor exceeds ω1 (startup permissible angular speed of the swing electric motor 25) at time T2, the gain K1 of the limit gain calculation block 83*c* shown in FIG. 4(A) becomes higher than 0. At this point, the gain K3 is also higher than 0 as shown in FIG. 4(C) since the gain K2 determined from the swing operation command signal "is" is higher than 0 as shown in FIG. 4(B) and the boom raising operation command "ib" has not been inputted. Therefore, the limit gain K determined as the product of the gains K1-K3 becomes higher than 0. Consequently, the limit torque KL outputted from the limit torque calculation block 83*d* shown in FIG. 3 is higher than or equal to 0.

In contrast, when the voltage value Vc of the capacitor 24 is higher than the operational threshold Vp, a positive output value P is outputted from the target power-running power calculation block 83*a* shown in FIG. 3 and a signal T that is higher than or equal to 0 is outputted from the target power-running torque calculation block 83*b*. Since the torque command value T (≥0) and the limit value KL (≥0) are inputted to the torque command value calculation block 83*e*, the torque command value EA as the output of the torque command value calculation block 83*e* becomes higher than or equal to 0 and is sent to the power control unit 55. Consequently, torque Te occurs in the swing electric motor 25.

At the same time, the hydraulic pump power reduction control block 83*f* shown in FIG. 3 outputs the power reduction command EB (for reducing the discharge flow rate of the hydraulic pump 41) so that the torque of the swing hydraulic motor 27 is reduced by the added torque Te of the swing electric motor 25. Therefore, as shown in FIG. 6, the torque To of the swing hydraulic motor 27 in this case is lower than the torque To in the case where the voltage value Vc of the capacitor 24 is lower than the operational threshold Vp (broken line) by the torque Te of the swing electric motor 25. As a result, the total torque Tt of the swing hydraulic motor 27 and the swing electric motor 25 takes on the same value in both cases (irrespective of whether the voltage value Vc of the capacitor 24 is higher or lower than the operational threshold Vp), and the swing motor angular speed ω also takes on the same value in both cases.

As above, the swing angular speed ω of the swing structure 20 does not change irrespective of whether or not the voltage value Vc of the capacitor 24 is less than the operational threshold Vp. Therefore, the hybrid construction machine of this embodiment is easy to operate for the operator. Further, the fuel consumption of the engine 22 can be reduced since the power of the hydraulic pump 41 can be reduced when the voltage value Vc of the capacitor 24 is the operational threshold Vp or higher.

Next, a problem that occurs in a combined operation of the swing operation of the swing structure 20 and the boom raising operation of the boom 31 will be explained referring to FIG. 7. FIG. 7 is a characteristic diagram showing an example of the relationship among the torque Te of the swing electric motor 25, the torque To of the swing hydraulic motor 27, the swing angular speed ω, etc. in the swing boom raising operation of hybrid construction machine. In order to clarify the characteristic features of this embodiment, FIG. 7 shows an example of the combined operation of the swing operation of the swing structure 20 and the boom raising operation of the boom 31 in a case where the limit gain calculation block 83*c* shown in FIG. 3 is operated in a mode not changing the limit gain depending on the boom raising operation amount (i.e., when the gain K3 shown in FIG. 4(*c*) is fixed at a constant value). In FIG. 7, the broken lines represent the operation when the voltage value Vc of the capacitor 24 is lower than the operational threshold Vp and the solid lines represent the operation when the voltage value Vc is higher than the operational threshold Vp. In each of the graphs of the swing operation command "is" of the swing structure 20 and the boom raising operation command "ib" of the boom 31, the broken line and the solid line coincide with each other.

Specifically, when the swing operation of the swing structure 20 and the boom raising operation of the boom 31 is started first at the same time T3, the torque To of the swing hydraulic motor 27, the total torque Tt, and bottom pressure Pb of the boom cylinder 32 increase and then the angular speed signal ω of the swing motor and the boom raising level Db increase following the torque To, the total torque Tt and the bottom pressure Pb. When the angular speed signal ω of the swing motor exceeds ω1 (startup permissible angular speed of the swing electric motor 25) at time T4, the gain K1 of the limit gain calculation block 83*c* shown in FIG. 4(A) becomes higher than 0. At this point, the gain K2 determined from the swing operation command signal "is" is higher than 0 as shown in FIG. 4(B), and the gain K3 is higher than 0 since the gain K3 is a fixed value. Therefore, the limit gain K determined as the product of the gains K1-K3 becomes higher than 0. Consequently, the limit torque KL outputted from the limit torque calculation block 83*d* shown in FIG. 3 is higher than or equal to 0.

In contrast, when the voltage value Vc of the capacitor 24 is higher than the operational threshold Vp, a positive output value P is outputted from the target power-running power calculation block 83*a* shown in FIG. 3 and a signal T that is higher than or equal to 0 is outputted from the target power-running torque calculation block 83*b*. Since the torque command value T (≥0) and the limit value KL (≥0) are inputted to the torque command value calculation block 83*e*, the torque command value EA as the output of the torque command value calculation block 83*e* becomes higher than or equal to 0 and is sent to the power control unit 55. Consequently, torque Te occurs in the swing electric motor 25.

At the same time, the hydraulic pump power reduction control block 83*f* shown in FIG. 3 outputs the power reduction command EB (for reducing the discharge flow rate of the hydraulic pump 41) so that the torque of the swing hydraulic motor 27 is reduced by the added torque Te of the swing electric motor 25. Therefore, as shown in FIG. 7, the torque To of the swing hydraulic motor 27 in this case is lower than the torque To in the case where the voltage value Vc of the capacitor 24 is lower than the operational threshold Vp (broken line). Further, since the hydraulic pump 41 supplies the hydraulic oil to both the swing hydraulic motor 27 and the boom cylinder 32, both the torque To of the swing hydraulic motor 27 and the bottom pressure Pb of the boom cylinder 32 decrease. Due to the decrease in the bottom pressure Pb of the boom cylinder 32, the decrease in the torque To of the swing hydraulic motor 27 becomes smaller than that in FIG. 6.

Consequently, the total torque Tt of the swing hydraulic motor 27 and the swing electric motor 25 when the voltage value Vc of the capacitor 24 is higher than the operational threshold Vp (solid line) becomes higher than that when the voltage value Vc is lower than the operational threshold Vp (broken line). The swing motor angular speed ω also becomes higher in the same way. On the other hand, the boom raising level Db when the voltage value Vc of the capacitor 24 is higher than the operational threshold Vp (solid line) becomes lower than that when the voltage value Vc is lower than the operational threshold Vp (broken line) due to the decrease in the bottom pressure Pb of the boom cylinder 32.

As above, when the voltage value Vc of the capacitor 24 is higher than the operational threshold Vp, the swing angular speed ω and the boom raising level Db become higher and lower respectively than those when the voltage value Vc is lower than the operational threshold Vp, which leads to poor operability of the hybrid construction machine for the operator. The difficulty in the operation will be explained below referring to FIG. 8.

In FIG. 8, the horizontal axis represents the swing angle θ of the swing structure 20 calculated from the swing motor angular speed ω shown in FIG. 7 (the integral of swing speed calculated as the product of the swing motor angular speed ω and the reduction ratio) and the vertical axis represents the boom raising level Db shown in FIG. 7. When the voltage value Vc of the capacitor 24 is lower than the operational threshold Vp (broken line), the boom raising level Db corresponding to the same swing angle θ is higher than that when the voltage value Vc is higher than the operational threshold Vp (solid line). Therefore, the following accident can occur in the operation of loading earth and sand onto a dump truck by performing the swing operation of the swing structure 20 and the boom raising operation of the boom 31 at the same time: If the operator performs the operation by assuming boom raising levels of the case where the voltage value Vc of the capacitor 24 is lower than the operational threshold Vp when the voltage value Vc is actually higher than the operational threshold Vp, the bucket of the hybrid construction machine can collide with the bed of the dump truck since the swing angular speed ω of the swing structure 20 is fast in comparison with the raising speed of the boom 31. Even if the collision can be avoided, the operator is required to carry out the operation more carefully than usual and feels difficulty in the operation.

To resolve this problem, in the calculation of the limit gain K by the limit gain calculation block 83*c* (see FIG. 3) in this embodiment, the limit gain K is modified by use of the gain K3 corresponding to the boom raising operation amount. An operation of the hybrid construction machine in accordance with the first embodiment of the present invention is shown in FIG. 9. FIG. 9 shows an example of the swing boom raising operation.

Specifically, when the swing operation of the swing structure 20 and the boom raising operation of the boom 31 is started first at the same time T3, the torque To of the swing hydraulic motor 27, the total torque Tt, and the bottom pressure Pb of the boom cylinder 32 increase and then the angular speed signal ω of the swing motor and the boom raising level Db increase following the torque To, the total torque Tt and the bottom pressure Pb. When the angular speed signal ω of the swing motor exceeds ω1 (startup permissible angular speed of the swing electric motor 25) at time T4, the gain K1 of the limit gain calculation block 83*c* shown in FIG. 4(A) becomes higher than 0. However, since the value of the boom raising operation command "ib" is high, the gain K3 becomes 0 and the limit gain K determined as the product of the gains K1-K3 also becomes 0. Consequently, the limit torque KL outputted from the limit torque calculation block 83*d* shown in FIG. 3 becomes 0 and the output EA from the torque command value calculation block 83*e* is limited to 0. Therefore, no torque Te occurs in the swing electric motor 25 irrespective of the magnitude relationship between the voltage value Vc of the capacitor 24 and the operational threshold Vp. Since the relationship between the swing motor angular speed ω and the boom raising level Db does not change irrespective of the change in the voltage value Vc of the capacitor 24, easy operability of the hybrid construction machine for the operator is realized.

According to the above-described first embodiment of the hybrid construction machine in accordance with the present invention, the torque command EA for the swing electric motor 25 is limited when the value of the boom raising operation command "ib" gets high. Therefore, satisfactory operability in the combined operation of the swing operation of the swing structure 20 and the boom raising operation of the boom 31 can be secured irrespective of the operating status of the swing electric motor 25.

Incidentally, while the combined operation of the swing operation of the swing structure 20 and the boom raising operation of the boom 31 has been explained in this embodiment, the actuator operated simultaneously with the swinging of the swing structure 20 is not restricted to the boom cylinder 32; this embodiment is applicable also to various combined operations of the swing operation and operations of other actuators.

Figure 10:
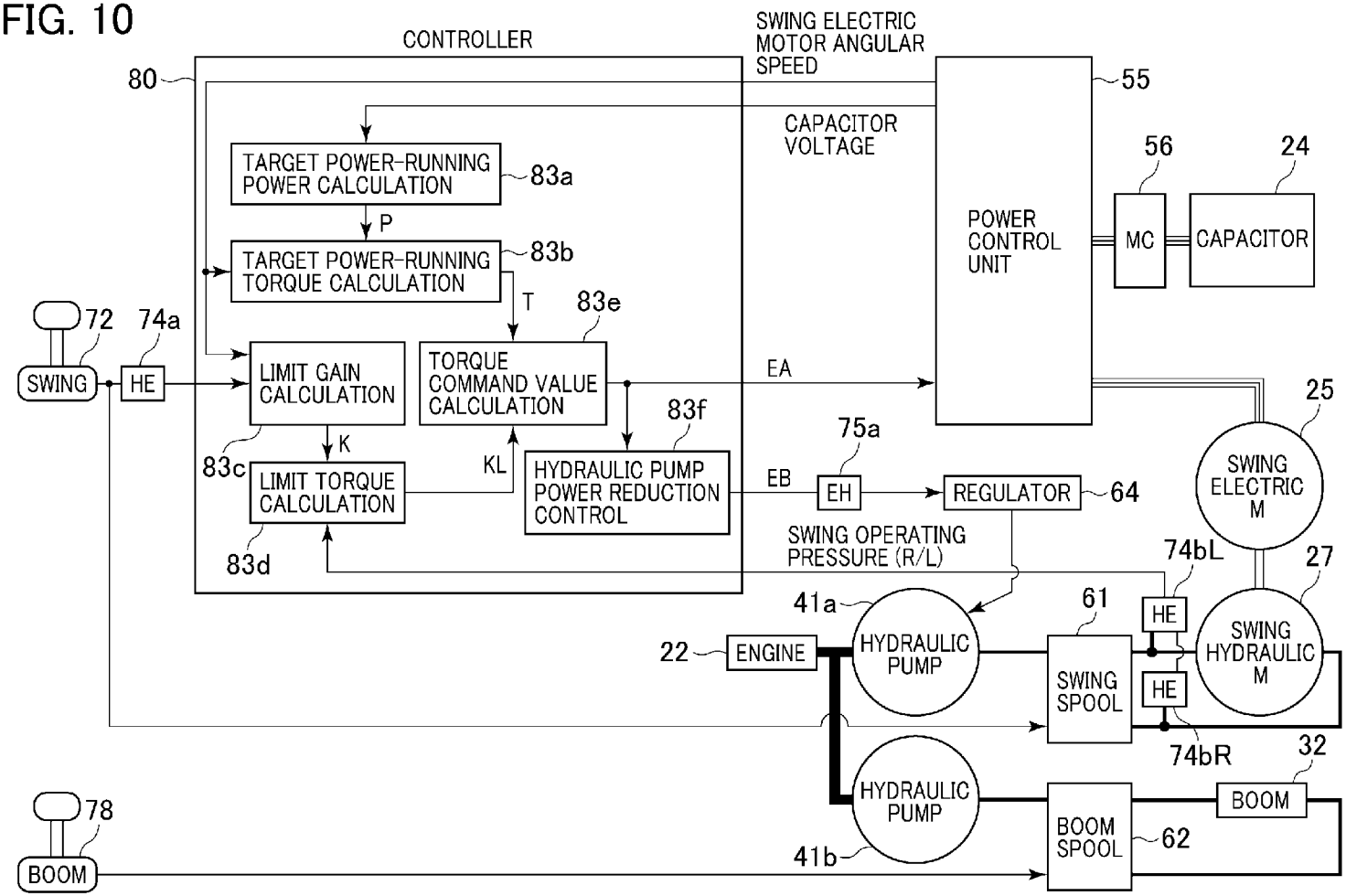
FIG. 10 is a block diagram showing the system configuration and control blocks of hybrid construction machine in accordance with a second embodiment of the present invention.

In the following, a hydraulic excavator as a hybrid construction machine in accordance with a second embodiment of the present invention will be described referring to FIG. 10. FIG. 10 is a block diagram showing the system configuration and control blocks of the hybrid construction machine in accordance with the second embodiment of the present invention. Reference characters in FIG. 10 identical with those in FIGS. 1-9 represent components identical or corresponding to those in FIGS. 1-9, and thus repeated explanation thereof is omitted for brevity.

This embodiment differs from the first embodiment in that a hydraulic pump 41*a* for supplying the hydraulic oil to the swing hydraulic motor 27 and a hydraulic pump 41*b* for supplying the hydraulic oil to the boom cylinder 32 are provided separately. The hydraulic pump 41*a* is controlled by the controller 80 via the regulator 64.

The functional block inside of the controller 80 differing from that in the first embodiment is the limit gain calculation block 83*c*. The limit gain calculation block 83*c* in this embodiment receives the angular speed signal ω of the swing electric motor 25 from the power control unit 55 and the swing operation command "is" converted into an electric signal by the hydraulic-electric conversion unit 74*a* as input signals, calculates gain outputs K1 and K2 from these values, calculates a limit gain K by multiplying the gain outputs K1 and K2 together, and outputs the calculated limit gain K. In other words, the limit gain calculation block 83*c* in this embodiment determines the limit gain K from the angular speed signal ω of the swing electric motor 25 and the swing operation command "is" only, without referring to the boom raising operation command "ib".

With this configuration, even when both the swing operation of the swing structure 20 and the boom raising operation of the boom 31 are under way, the control for generating the torque Te of the swing electric motor 25 and reducing the power of the hydraulic pump 41*a* by an amount corresponding to the added torque of the swing electric motor 25 is carried out if the voltage value Vc of the capacitor 24 is higher than the operational threshold Vp.

Since the hydraulic pump 41*a* for supplying the hydraulic oil to the swing hydraulic motor 27 and the hydraulic pump 41*b* for supplying the hydraulic oil to the boom cylinder 32 are independent of each other, the bottom pressure of the boom cylinder 32 does not decrease even though the torque To of the swing hydraulic motor 27 is reduced by the added torque of the swing electric motor 25. Thus, even when the voltage value Vc of the capacitor 24 gets higher or lower than the operational threshold Vp, the total torque Tt of the swing hydraulic motor 27 and the swing electric motor 25 does not change, nor does the bottom pressure Pb of the boom cylinder 32. Consequently, the hybrid construction machine of this embodiment is easy to operate for the operator since the relationship between the swing motor angular speed ω and the boom raising level Db does not change even when the voltage value Vc of the capacitor 24 gets higher or lower than the operational threshold Vp.

According to the above-described second embodiment of the hybrid construction machine in accordance with the present invention, the hydraulic pump 41*a* for supplying the hydraulic oil to the swing hydraulic motor 27 and the hydraulic pump 41*b* for supplying the hydraulic oil to the boom cylinder 32 are provided separately. Even when both the swing operation of the swing structure 20 and the boom raising operation of the boom 31 are under way, the control for generating the torque of the swing electric motor 25 and reducing the power of the hydraulic pump 41*a* by an amount corresponding to the added torque of the swing electric motor 25 is carried out if the voltage value Vc of the capacitor 24 is higher than the operational threshold Vp. Therefore, satisfactory operability in the combined operation of the swing operation of the swing structure 20 and the boom raising operation of the boom 31 can be secured irrespective of the operating status of the swing electric motor 25.

Figure 11:
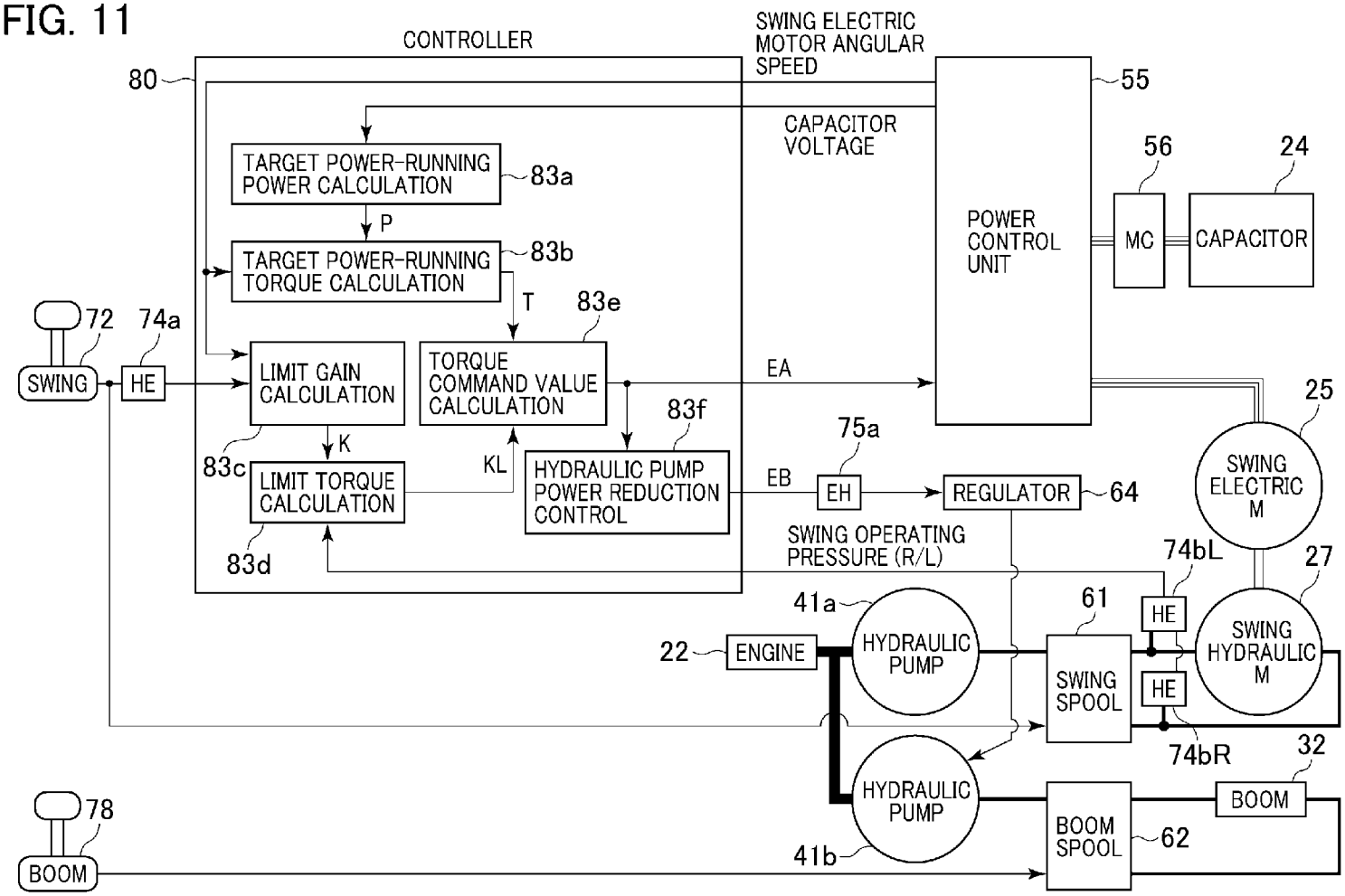
FIG. 11 is a block diagram showing the system configuration and control blocks of hybrid construction machine in accordance with a third embodiment of the present invention.

In the following, a hydraulic excavator as a hybrid construction machine in accordance with a third embodiment of the present invention will be described referring to FIG. 11. FIG. 11 is a block diagram showing the system configuration and control blocks of the hybrid construction machine in accordance with the third embodiment of the present invention. Reference characters in FIG. 11 identical with those in FIGS. 1-10 represent components identical or corresponding to those in FIGS. 1-10, and thus repeated explanation thereof is omitted for brevity.

In this embodiment, the hydraulic pump 41*a* for supplying the hydraulic oil to the swing hydraulic motor 27 and the hydraulic pump 41*b* for supplying the hydraulic oil to the boom cylinder 32 are provided separately in the same way as the second embodiment. This embodiment differs from the second embodiment in that the hydraulic pump 41*b* is controlled by the controller 80 via the regulator 64.

The functional block inside of the controller 80 differing from that in the first embodiment is the hydraulic pump power reduction control block 83*f*. In the first embodiment, the hydraulic pump power reduction control block 83*f* receives the torque command value EA calculated by the torque command value calculation block 83*e* as an input signal and outputs the power reduction command EB (for reducing the discharge flow rate of the hydraulic pump 41) so that the torque of the swing hydraulic motor 27 is reduced by the added torque of the swing electric motor 25. This embodiment differs from the first embodiment in that the hydraulic pump power reduction control block 83*f* receives the torque command value EA calculated by the torque command value calculation block 83*e* as an input signal and outputs a power enhancement command EB for increasing the discharge flow rate of the hydraulic pump 41*b* (supplying the hydraulic oil to the boom cylinder 32) by the added torque of the swing electric motor 25. In other words, the control in this embodiment is executed so as to enhance the power of the hydraulic pump 41*b* when the torque of the swing electric motor 25 is increased, and to reduce the power of the hydraulic pump 41*b* when the torque of the swing electric motor 25 is reduced.

Similarly to the second embodiment, the limit gain calculation block 83*c* of the controller 80 determines the limit gain K from the angular speed signal ω of the swing electric motor 25 and the swing operation command "is" only, without referring to the boom raising operation command "ib".

With this configuration, when the torque Te of the swing electric motor 25 cannot be generated due to low voltage value Vc of the capacitor 24 lower than the operational threshold Vp, the swing angular speed ω decreases; however, the power of the hydraulic pump 41*b* also decreases correspondingly and that causes the boom raising speed to also decrease. Thus, even when the voltage value Vc of the capacitor 24 gets higher or lower than the operational threshold Vp, the relationship between the boom raising level Db and the swing angle θ remains substantially the same (the relationship indicated by the solid line in FIG. 8 can always be realized, for example), leading to easy operability for the operator.

According to the above-described third embodiment of the hybrid construction machine in accordance with the present invention, the hydraulic pump 41*a* for supplying the hydraulic oil to the swing hydraulic motor 27 and the hydraulic pump 41*b* for supplying the hydraulic oil to the boom cylinder 32 are provided separately. Even when the swing boom raising operation is under way, the control for generating the torque of the swing electric motor 25 and enhancing the power of the hydraulic pump 41*b* by an amount corresponding to the added torque of the swing electric motor 25 is carried out if the voltage value Vc of the capacitor 24 is higher than the operational threshold Vp. Therefore, satisfactory operability in the combined operation of the swing operation of the swing structure 20 and the boom raising operation of the boom 31 can be secured irrespective of the operating status of the swing electric motor 25.

DESCRIPTION OF REFERENCE CHARACTERS

10 track structure
11 crawler
12 crawler frame
13 right travel hydraulic motor
14 left travel hydraulic motor
20 swing structure
21 swing frame
22 engine
23 assist power generation motor
24 capacitor
25 swing electric motor
26 speed reduction mechanism
27 swing hydraulic motor
30 excavation mechanism
31 boom
32 boom cylinder
33 arm
35 bucket
40 hydraulic system
41 hydraulic pump
42 control valve
43 hydraulic line
51 chopper
52 inverter for swing electric motor
53 inverter for assist power generation motor
54 smoothing capacitor
55 power control unit
56 main contactor
57 main relay
58 inrush current prevention circuit
61 swing spool
62 boom spool
64 regulator
72 swing operating lever device
78 boom operating lever device
80 controller (control device)
83*a* target power-running power calculation block
83*b* target power-running torque calculation block
83*c* limit gain calculation block
83*d* limit torque calculation block
83*e* torque command value calculation block
83*f* hydraulic pump power reduction control block

The invention claimed is:

1. Hybrid construction machine comprising:

a prime mover (22);

a hydraulic pump (41) which is driven by the prime mover (22);

a swing structure (20);

an electric motor (25) for driving the swing structure;

a hydraulic motor (27) for driving the swing structure, the hydraulic motor being driven by the hydraulic pump (41);

an electrical storage device (24) which is connected to the electric motor (25);

a swing operating lever device (72) which is operated for commanding the driving of the swing structure (20);

a second hydraulic actuator (32) which is driven by the hydraulic pump (41) and drives a driven part other than the swing structure (20);

a second operating lever device (78) which is operated for commanding the driving of the second hydraulic actuator (32); and a control device (80) which executes control selected from:

hydraulic/electric complex swing control for driving the swing structure (20) by total torque of the electric motor (25) and the hydraulic motor (27) by driving both the electric motor (25) and the hydraulic motor (27) when the swing operating lever device (72) is operated; and hydraulic solo swing control for driving the swing structure (20) by the torque of the hydraulic motor (27) alone by driving only the hydraulic motor (27) when the swing operating lever device (72) is operated, wherein:

the control device (80) controls drive torque of the electric motor (25), drive torque of the hydraulic motor (27) and driving force of the second hydraulic actuator (32) so that the relationship between the position or the speed of the second hydraulic actuator (32) and the swing angle or the swing speed of the swing structure (20) when the swing operating lever device (72) and the second operating lever device (78) are operated at the same time during the hydraulic/electric complex swing control is substantially identical with the relationship between the position or the speed of the second hydraulic actuator (32) and the swing angle or the swing speed of the swing structure (20) when the swing operating lever device (72) and the second operating lever device (78) are operated at the same time during the hydraulic solo swing control.

2. The hybrid construction machine according to claim 1, wherein when the swing operating lever device (72) and the second operating lever device (78) are operated at the same time during the hydraulic/electric complex swing control, the control device (80) controls the drive torque of the electric motor (25) so that the ratio of the drive torque of the electric motor (25) to the drive torque of the hydraulic motor (27) decreases with the increase in the operation amount of the second operating lever device (78).

3. The hybrid construction machine according to claim 1, wherein when the swing operating lever device (72) is operated during the hydraulic/electric complex swing control, the control device (80) increases the drive torque of the electric motor (25) and controls the drive torque of the hydraulic motor (27) so as to reduce the drive torque of the hydraulic motor (27) by an amount corresponding to the increase in the drive torque of the electric motor (25).

4. The hybrid construction machine according to claim 1, wherein when the swing operating lever device (72) and the second operating lever device (78) are operated at the same time during the hydraulic solo swing control, the control device (80) controls the driving force of the second hydraulic actuator (32) so as to reduce the driving force of the second hydraulic actuator (32).

5. The hybrid construction machine according to claim 1, wherein:

the second hydraulic actuator is a boom cylinder (32), and the second operating lever device is a boom raising operating lever device (78).

6. The hybrid construction machine according to claim 3, wherein the control device (80) reduces the drive torque of the hydraulic motor (27) by performing reduction control on the output of the hydraulic pump (41).

7. The hybrid construction machine according to claim 4, wherein the control device (80) reduces the driving force of the second hydraulic actuator (32) by performing reduction control on the output of the hydraulic pump (41).

* * * * *